United States Patent [19]

Sansores

[11] Patent Number: 4,673,184

[45] Date of Patent: Jun. 16, 1987

[54] SEATING SURFACE/GAMEBOARD DEVICE

[76] Inventor: Roy Sansores, 1933 Park Ave., Bensalem, Pa. 19020

[21] Appl. No.: 686,186

[22] Filed: Dec. 26, 1984

[51] Int. Cl.[4] ..... A63F 3/00

[52] U.S. Cl. ..... 273/286; 273/DIG. 30

[58] Field of Search ..... 273/286, 285, 287, 309; 428/81, 193; 206/315.1; 383/4; 54/79

[56] References Cited

U.S. PATENT DOCUMENTS

| | | | |
|---|---|---|---|
| 1,269,276 | 6/1918 | Harris | 273/286 |
| 3,862,876 | 1/1975 | Graves | 428/193 |
| 3,948,528 | 4/1976 | Goodman et al. | 273/286 |
| 4,330,120 | 5/1982 | Netti | 273/DIG. 30 X |

*Primary Examiner*—Richard C. Pinkham

*Assistant Examiner*—Matthew L. Schneider

*Attorney, Agent, or Firm*—Caesar, Rivise, Bernstein, Cohen & Pokotilow, Ltd.

[57] ABSTRACT

A seating surface/gameboard device comprising a web of flexible material for disposition on an outdoor surface, such as the beach. The web is sufficiently large to enable a person to sit thereon and includes gameboard indicia printed thereon. At least one marginal edge of the web includes a releasably openable pocket. The pocket is adapted to receive particulate material, such as sand, to weight the edge down against the effects of wind, while providing a comfortable surface on which a person can sit. The pocket includes releasably secureable hook and loop type fasteners for providing ready access to the interior of the pocket to fill it or to empty it.

6 Claims, 2 Drawing Figures

SEATING SURFACE/GAMEBOARD DEVICE

BACKGROUND OF THE INVENTION

This invention relates generally to game apparatus and more particularly to gameboards for use outdoors.

Various board games are commercially available and which utilize a hard or rigid board on which various games pieces are placed for movement. While such boards are suitable for their intended purposes they are not particularly suited for use outdoors, such as on the beach, inasmuch as they may not conform to the uneven surface of the terrain, e.g., the sand. Some towels, bedspreads, carpets or other webs of fabric are available as surfaces on which one can sit to play a game having a game board pattern imprinted thereon, e.g., a checker board pattern, a backgammon pattern, etc. While such webs conform to the contours of the surface on which they are put better than rigid game boards, they still leave much to be desired from the standpoint of utility. In this regard when such fabric webs are used outdoors as seating surfaces they are suseptible to the effects of the wind, e.g., the fabric may flap or blow about in the wind.

OBJECT OF THE INVENTION

Accordingly, it is a general object of the invention to provide a seating surface/gameboard apparatus which overcomes the disadvantages of the prior art.

It is a further object of this invention to provide a seating/surface gameboard apparatus which is formed of a web of material sufficiently large enough to enable at least one person to sit thereon and including means to prevent the web from being disturbed by the wind.

It is still a further object of the instant invention to provide a seating/surface gameboard device which includes anchoring means for preventing it from blowing in the wind, while still providing a comfortable surface upon which one can sit.

It is still a further object of the instant invention to provide a seating/surface gameboard device which is light in weight and which can be readily folded or packed for storage, yet which includes fillable anchoring means to anchor the device against the effects of wind.

SUMMARY OF THE INVENTION

A seating surface/gameboard device comprising a web of flexible material arranged to be readily folded and unfolded for placement on an uneven horizontal outdoor surface and sufficiently large to allow at least one person to sit comfortably thereon. The web includes game indicia thereon and has at least one marginal edge including anchoring means located thereat. The anchoring means comprises at least one pocket adapted to receive particulate material to weight the edge down against the effects of the wind, while providing a comfortable surface on which the person can sit. The pocket includes releasably secureable fastening means providing ready ingress to the interior of the pocket to fill the pocket with the particulate material and to seal the material therein. The releaseable secureable means is also readily openable to enable the emptying of the material from the pocket to render the web flat, whereupon the web can be readily folded for compact storage.

DESCRIPTION OF THE PREFERRED EMBODIMENT

Figure 1:
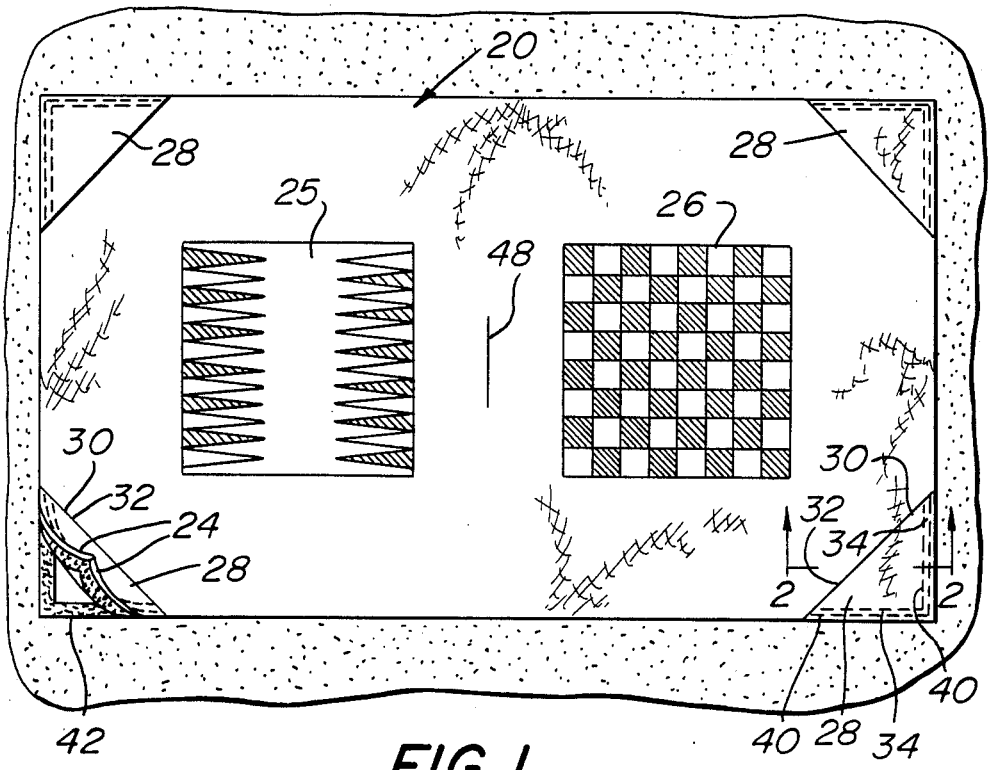
FIG. 1 is a top planned view of one embodiment of a seating surface/gameboard device constructed in accordance with the instant invention.

Referring now in greater detail to the various figures in the drawing wherein like reference characters refer to like parts, there is shown a seating surface/gameboard device 20 constructed in accordance with the subject invention. The device basically comprises a web of flexible material, e.g., cloth or fabric, which is arranged to be disposed on an horizontal outdoor surface 22, such as a beach. The flexibility of the web allows it to conform to the contours of that surface. The web is sufficiently large to enable at least one person to sit on the web when it is spread out on the surface. In the embodiment shown, the web is of generally rectangular shape. Such a shape is purely exemplary and any other shape can be used for the invention.

The web 20 includes indicia forming two gameboards located thereon. In particular backgammon indicia 25 is printed on the left portion of the top surface of the web while checker board indicia 26 is printed on the top surface of the right portion of the web. It must be pointed out at this juncture that the indicia 25 and 26 are also merely exemplary and other gameboard indicia (single gameboards or plural game indicia) can be printed or otherwise applied to the top surface of the web.

As can be seen clearly in FIG. 1 in each corner of the marginal edges of the web there is formed a respective pocket 28. The pockets collectively serve as anchoring means for the web to hold the web firmly in place on the support surface, e.g., the beach, against the effects of wind. Each pocket 28 is constructed in the identical manner. Moreover, while four pockets 28 are shown, one in each corner, it is clear that any number of pockets may be utilized and further that the pockets 28 need not be located at the corners of the web but can be at any portion(s) of the marginal edge of the web. Thus, one or plural pockets 28 can be used for holding the marginal edges of the web in place when it is spread out.

Figure 2:
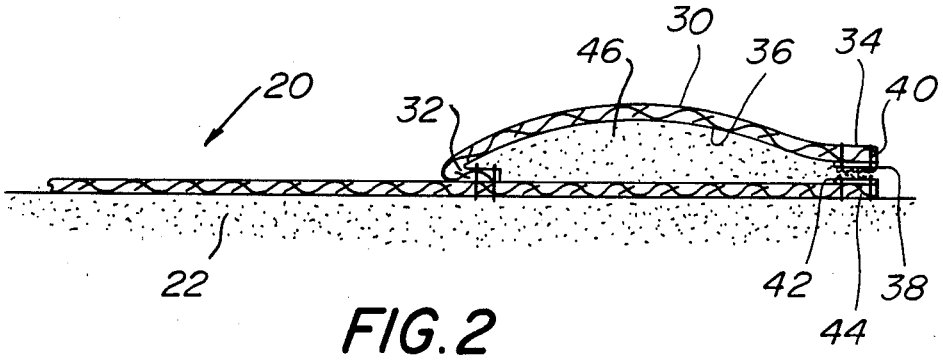
FIG. 2 is an enlarged sectional view taken along line 2—2 of FIG. 1.

Referring now to FIG. 2 the details now of one pocket 28 will now be described. As can be seen the pocket 28 consists of a triangular flap of material or fabric 30 which is fixedly secured, such as by a line of stitching 32 to the web 20. The stitch line 32 is along the hypotenuse of the triangular flap 30. The underside surface 36 of the flap 30 contiguous with its legs 34 has mounted thereon a strip 38 of one component of a two component releasable fastening system, such as the VELCRO Fastening System sold by Velcro Products. The strip 38 can either comprise the multiple hook component of the Velcro system or the multiple loop (plush) component. In either case the strip 38 is fixedly secured to the underside surface of the triangular fabric piece 30 via stitching. A strip of the other component 42 of the Velcro Fastening System is fixedly secured along the marginal edges of the web 20 directly under the strips 38. The strips 42 are also secured in place via stitching 44. The strips 38 and 42 are arranged to releasably secure each other upon their contact or engagement, thus closing the interior of the pocket 28.

As will be appreciated by those skilled in the art by merely grasping the corner of the triangular flap 30 one can peel the flap back like shown in the lower left corner in FIG. 1. This provides ready access to the interior of the pocket formed by the flap 30 and the underlying portion of the web 20. Sand 46 or other particulate material can then be inserted into the pocket and then the flap 30 brought back down so that the Velcro component 38 engages the Velcro component 42, thereby closing the pocket and sealing the material therein.

The weight provided by the filled pockets serves to prevent the corners or marginal edges of the fabric from flapping or blowing in the wind when the web is spread out outdoors, thereby holding it in place irrespective of wind conditions.

Inasmuch as the pocket 28 is filled with sand its upper surface forms a rounded or convex shape which is soft and thus serves as a cushiony support for any portion of the person disposed thereon. Accordingly, persons can readily use the gameboard by sitting or resting on the web without any discomfort caused by the presence of any of the filled pockets.

As can be seen in FIG. 1 a slot or slit 48 is provided in the middle of the web. This slit serves as an opening through which the shaft or stem of an umbrella (not shown) can be extended for placement in the sand to provide coverage over the gameboard.

After use and when it is desired to pack or stow away the device 20 all that is required is to peel back the corners of each of the pockets to expose the interior thereof, whereupon the sand can be emptied therefrom, the pockets closed and the web then folded or rolled up in a compact manner for storage.

While the device 20 has been described heretofore as being made up of a web of fabric or cloth, it is clear that the web can be of any suitable material, such as plastics, etc., providing that the same is readily conformable to the surface of the ground and is sufficiently flexible to enable readily opening and closing of the pockets and folding of the web. Moreover, it must be pointed out that while the releasably secureable fastening means has been described as being formed of Velcro, it is clear that other fastening means can be utilized, such as zippers, buttons, etc.

Without further elaboration, the foregoing will so fully illustrate my invention that others may, by applying current or future knowledge, readily adopt the same for use under various conditions of service.

I claim:

1. A seating surface/gameboard device comprising a web of flexible material arranged to be readily folded and unfolded for placement on an outdoor surface and sufficiently large to enable at least one person to sit thereon, said web being flexible over its entire area and foldable lengthwise and said web including game indicia thereon and having four corners and a marginal edge including four anchoring means each located at a corner thereon, each of said anchoring means being fixedly secured to said web and comprising a hollow flexible pocket wth sand placed therein to weight said edge down against the effects of wind, while providing a comfortable surface on which said person can sit, said pocket being readily openable along a sufficient length thereof to expose the entire interior thereof and including releasable securable fastening means to facilitate such opening and thereby provide ready ingress into entire interior of said pocket to enable it to be filled with said sand, said releasably secureable fastening means enabling said pocket to be readily closed to seal said sand therein, said releaseably secureable fastening means also enabling said pocket to be readily opened to enable removal of said sand whereupon said web can be readily folded for compact storage.

2. The device of claim 1 wherein said fastening means comprises a two component fastening system.

3. The device of claim 2 wherein said two component fastening system comprises one component including a plurality of hook-like elements and a second component comprising a plurality of loop-like elements, said hook-like elements and said loop-like elements being arranged to grasp each other when brought into contact with each other.

4. A seating surface/gameboard device comprising a web of flexible material arranged to be readily folded and unfolded for placement on an outdoor surface and sufficiently large to enable at least on person to sit thereon, said web including game indicia thereon and having at least one marginal edge including anchoring means located thereat, said anchoring means comprising at least one hollow pocket and having releaseably secureable fastening means located thereat to enable the opening of the pocket for receipt of particulate material therein to weight said edge down against the effects of wind, while providing a comfortable surface on which said person can sit, said releaseably secureable fastening means of said pocket providing ready ingress to the interior of said pocket to enable it to be filled with said particulate material and for sealing said material therein, said releasably secureable fastening means being readily openable to enable the emptying of said particulate material from said pocket to render said web flat, whereupon said web can be readily folded for compact storage, said web comprising an opening in an intermediate portion thereof and through which the shaft of an umbrella may be extended.

5. The device of claim 4 wherein said fastening means comprises a two component fastening system.

6. The device of claim 5 wherein said two component fastening system comprises one component including a plurality of hook-like elements and a second component comprising a plurality of loop-like elements, said hook-like elements and said loop-like elements being arranged to grasp each other when brought into contact with each other.

* * * * *